US011684838B2

(12) United States Patent
Alexander

(10) Patent No.: US 11,684,838 B2
(45) Date of Patent: Jun. 27, 2023

(54) MARTIAL ARTS TRAINING DUMMY

(71) Applicant: The Rolling Fool, LLC, Dallas, TX (US)

(72) Inventor: H. Clay Alexander, Dallas, TX (US)

(73) Assignee: The Rolling Fool, LLC, Dallas, TX (US)

( * ) Notice: Subject to any disclaimer, the term of this patent is extended or adjusted under 35 U.S.C. 154(b) by 49 days.

(21) Appl. No.: 17/565,769

(22) Filed: Dec. 30, 2021

(65) Prior Publication Data

US 2022/0212080 A1 Jul. 7, 2022

Related U.S. Application Data

(60) Provisional application No. 63/134,489, filed on Jan. 6, 2021.

(51) Int. Cl.
*A63B 69/34* (2006.01)
*A63B 69/20* (2006.01)

(52) U.S. Cl.
CPC ..... *A63B 69/34* (2013.01); *A63B 69/215* (2022.08); *A63B 2209/00* (2013.01); *A63B 2244/10* (2013.01)

(58) Field of Classification Search
CPC ..... A63B 69/215; A63B 69/34; A63B 69/203; A63B 69/22; A63B 69/222; A63B 69/224; A63B 69/24; A63B 69/244; A63B 69/26; A63B 69/305; A63B 2209/00; A63B 2244/10
See application file for complete search history.

(56) References Cited

U.S. PATENT DOCUMENTS 4,088,315 A * 5/1978 Schemmel ..... F16B 7/10 482/84
5,700,230 A * 12/1997 Cardona ..... A63B 69/34 482/90
6,063,011 A * 5/2000 Pelchat ..... A63B 69/215 482/90
9,050,514 B1 * 6/2015 Mirza ..... A63B 69/215
2008/0015093 A1 * 1/2008 Helton ..... A63B 69/22 482/83
2014/0335493 A1 * 11/2014 Iocca ..... A63B 69/34 434/256
2019/0143189 A1 * 5/2019 Elmore ..... A63B 69/004 473/438
2022/0362649 A1 * 11/2022 Lee ..... A63B 69/215

* cited by examiner

*Primary Examiner* — Megan Anderson
(74) *Attorney, Agent, or Firm* — Conley Rose, P.C.; William H. Dietrich

(57) ABSTRACT

A training dummy having a waist portion, a first leg coupled to the waist portion, a second leg coupled to the waist portion, a first foot coupled to the first leg, and a second foot coupled to the second leg. At least one of the first foot or the second foot includes a front foot portion, a back foot portion, and a rod assembly coupling the front foot portion to the back foot portion. The front foot portion is configured to move with respect to the back foot portion.

20 Claims, 17 Drawing Sheets

MARTIAL ARTS TRAINING DUMMY

CROSS-REFERENCE TO RELATED APPLICATIONS

This application claims priority to U.S. Provisional Patent Application No. 63/134,489, filed Jan. 6, 2021, and titled "Martial Arts Training Dummy," which is incorporated by reference.

BACKGROUND

Brazilian Jiu Jitsu (BJJ) is a martial art that is focused on overwhelming an opponent through grappling and control rather than strikes or kicks. The objective of every match is to get your opponent to the ground and then use techniques that apply pressure to joints (e.g., elbow, knee, ankle, etc.) or to the neck (e.g., in order to choke the opponent) to make your opponent concede defeat or submit.

BJJ developed as an off shoot of Judo. In Judo, the goal is to get your opponent to the ground. But once there, the match is effectively over. In the 1920s, the Gracie brothers from Brazil (Helio, George, and Carlos), who were trained in Judo, started to develop specific ground martial arts techniques that evolved into what is currently known as BJJ.

There are strict rules about what is permissible and what is not within a BJJ match. Actions such as hair pulling, or the grabbing of a finger or toe are strictly forbidden. The objective is to isolate, for example, an arm or leg and use joint pressure to force your opponent to submit. Another technique involves getting behind your opponent, e.g., getting your opponent on their back and choking them. This is a very difficult sport and the techniques take years to learn. It typically takes about 8-10 years to become a black belt.

The attacks that are most feared in BJJ are known as leg locks as they can lead to significant injuries. Leg lock submissions are considered the most complex and highest tier of submissions in BJJ. These attacks target the knees, ankles, and feet. The difficulty in learning leg locks is that after a few minutes of drilling, the knees and ankles can become tender. Even gentle practice, i.e., placing a minimum amount of pressure on the area of a sparring partner, will, over the course of several minutes, cause soreness. This is especially true for the knee; it is not meant to move in any other direction other than back and forth. This makes training and progressing in applying leg locks a long and painful process. Moreover, leg locks are complicated, difficult to teach, and hard to drill. When done incorrectly, a leg lock may cause injury to a practice partner.

Various versions of dummies that can be used to practice martial arts exist. Dummies used for punching exist for the punching techniques in some martial arts. However, these types of dummies are not useful in BJJ because of the submission-focused nature of the art.

Other martial arts dummies are commercially available that can be used for BJJ because they can be laid on the ground to practice submission positions. However, these commercially available dummies are typically plush (i.e., have no skeleton or internal support structure) with minimal form and offer no resistance or realisic feel.

Other types of dummies that are commercially available include crash test dummies, dummies used to train first responders (e.g., firefighters, paramedics), and dummies used for combat training. Some of these dummies can be filled with water to simulate the body weight of a real human, and most versions have movable arms and legs that simulate the arm and leg movements of the human body.

However, the ankles and feet of these dummies do not move, and the bodies are usually made of hard plastic.

One can also make a home-made BJJ training dummy. For example, a BJJ training dummy can be homemade with lengths of 1"×1" wood strung together with yellow nylon rope to form a skeleton. This make-shift skeleton can be surrounded by a mixture of rags and plastic bags for padding, and then held together with duct tape. However, dummies made in this nature are not realistic in feel and weight and have limited longevity.

SUMMARY

A training dummy comprising a waist portion, a first leg coupled to the waist portion, a second leg coupled to the waist portion, a first foot coupled to the first leg, and a second foot coupled to the second leg. The first foot and/or the second foot comprises a front foot portion, a back foot portion, and a rod assembly coupling the front foot portion to the back foot portion. The front foot portion is configured to move with respect to the back foot portion.

BRIEF DESCRIPTION OF THE SEVERAL VIEWS OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
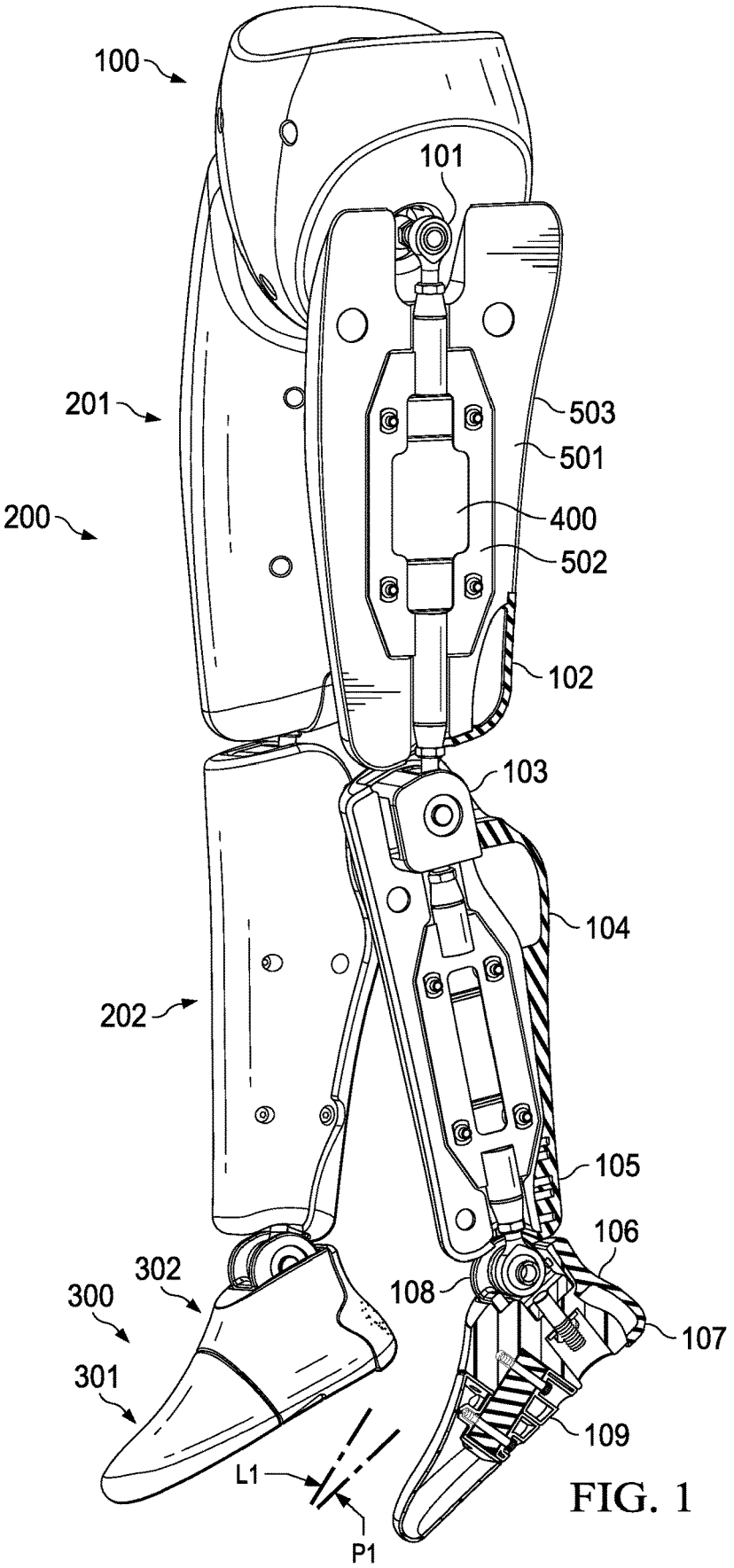
FIG. 1 illustrates a perspective view of the lower half of a martial arts dummy according to the present disclosure.

It should be understood at the outset that although illustrative implementations of one or more embodiments are illustrated below, the dummy may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, the term "leg lock" includes any joint manipulation or pain inflicted on the legs that causes your opponent to give up or tap out. While there are many ways to attack the legs, the vast majority of Brazilian Jiu Jitsu (BJJ) leg locks fall within four categories: knee bar, straight ankle lock, heel hook, and toe hold.

Knee Bars.

BJJ knee bars focus on hyper extending the knee of the opponent. This is done by controlling both the hip and the heel of your opponent, using your hip as a fulcrum on top of the knee cap and arching your back. This action puts pressure on the back of the knee and if done correctly can tear the opponent's anterior cruciate ligament (ACL).

Straight Ankle Lock.

Rather than attacking a joint, the BJJ straight ankle lock attacks the Achilles tendon. The straight ankle lock can be considered a pain submission because the straight ankle lock does not put a joint in jeopardy of injury. To accomplish this technique, the calf of an opponent is controlled by trapping the opponent's foot in the attacker's armpit. Next, the attacker slides their forearm along the opponent's calf until the Achilles tendon is reached. Once the attacker's forearm is locked in position, the attacker squeezes their arm tight and leans back.

Heel Hook.

The heel hook is one of the most popular BJJ leg lock techniques, but is also one of the most difficult to master. This submission uses an opponent's heel to rotate the opponent's knee while the attacker's legs prevent the opponent's hips from rotating and following their knee. This torques the knee clockwise, which puts a tremendous amount of pressure on the ligaments. The technique can easily tear both the medial collateral ligament (MCL) and the ACL very quickly as very little pressure is needed to rotate the knee.

Toe Hold.

The BJJ toe hold technique forces an over rotation of the foot and ankle by using the attacker's forearm to act as a fulcrum on the inside of the opponent's ankle as the attacker's other hand rotates the opponents toes towards their groin. The ligaments on the outside of the ankle that run down to the toes are strained, which causes a significant amount of pain for the opponent. This can be considered more of a pain submission rather than a true joint submission.

As noted above, available martial art training dummies fail to provide realistic articulation, weight, and movement of the lower half of a human being. To resolve this problem, disclosed herein is a martial art training dummy that provides a more realistic articulation, weight, and movement of the lower half of human. Because of the disclosed martial art training dummy, practicing BJJ is safer without sacrificing the actual forces needed in the submission positions for, in particular, leg locks.

The disclosed martial arts dummy provides 1) a knee that does not over-extend, 2) an area to learn where the attacker can place legs and arms to apply pressure for a straight ankle lock, 3) the correct articulation of both knee and ankle to recreate the heel hook, and 4) the rotating foot motion necessary to practice a toe hold. Because of one or more of these features, the disclosed martial arts dummy allows a student of any level to drill leg locks without the possibility of injuring anyone and at their own pace.

FIG. 1 illustrates a perspective view of the lower half of a martial arts or training dummy according to the present disclosure. As shown, the lower half of a martial arts dummy represents the lower half of a human being. Although an upper half of the training dummy is not discussed in the present disclosure, one of ordinary skill in the art would appreciate that the lower half of the training dummy disclosed herein can be coupled to an upper body portion comprising a torso, head, and arms.

As shown in FIG. 1, the lower half comprises a waist portion 100, two legs 200 connected to the waist portion 100, and a foot 300 connected to each of the legs 200. The left leg of the two legs 200 is shown in cut-away view so as to illustrate the components of the skeleton 400 and soft tissue 501 and 502, as well as skin 503.

In an embodiment, the skeleton 400 can be formed of a hard material that is resistant to bending under applied pressure, such as a metal or metal alloy.

The soft tissue 501 can be made of thermoplastic elastomers (e.g., comprising silicon, polyurethane, a polyurethane blend, polyethylene, or a combination thereof). These exemplary polymers are not meant to limit the scope of material that can be used for the soft tissue 501.

The soft tissue 502 can be made of thermoplastic elastomers (e.g., comprising silicon, polyurethane, a polyurethane blend, polyethylene, or a combination thereof). In some aspects, the material of soft tissue 502 has a hardness greater than a hardness of the material from which the soft tissue 501 is made and less than a hardness of the material from which the skeleton 400 is made.

The skin 503 can be made of polyethylene, silicon, an open cell foam, or a combination thereof.

Each leg 200 has an upper leg 201 and a lower leg 202. The upper leg 201 of each leg 200 is connected to the waist portion 100 by a hip joint 101. The upper leg 201 of each leg 200 is connected to the lower leg 202 of each leg 200 by a knee assembly 103. Each lower leg 202 of each leg 200 is connected to the foot 300 by an ankle assembly 108.

Each hip joint 101 connects to the waist portion 100 and to an upper leg 201 of each leg 200. Each hip joint 101 can be configured to provide motion between the waist portion 100 and each leg 200. Each hip joint 101 has minimal axial rotation (+/−10°) with respect to a longitudinal axis of the upper leg 201, while having the following ranges of motion:

Flexion: 0°-125°
Extension 115°-0°
Abduction: 0°-45°
Adduction 45°-0°
Lateral Rotation: 0°-45°
Medial Rotation: 0°-45°

The bottom of each upper leg 201 has a first compressible pad 102 that is contoured to the shape of the lower portion of a hamstring muscle to simulate soft tissue at a first point of contact. The compressible pad 102 can be formed of silicon or like material, as solid polymer or foam polymer.

The knee assembly 103 can be a machined metal block as shown in FIG. 1. The knee assembly 103 is configured to provide limited bending angle and having side neoprene washers to simulate a soft pressure point of contact. The knee assembly 103 has the following ranges of motion:

Flexion: 0°-130°
Extension: 120°-0°

The top of the lower leg 202 of each leg 200 has a second compressible pad 104 contoured to the shape of a human calf muscle to simulate soft tissue at a second point of contact. The second compressible pad 104 can be formed of silicon or like material, as solid polymer or foam polymer.

The bottom of the lower leg 202 of each leg 200 has a third compressible pad 105 to simulate the soft tissue at a third point of contact. The third compressible pad 105 can be formed of silicon or like material, as solid polymer or foam polymer. In some embodiments, the second compressible pad 104 and the third compressible pad 105 can be combined as one compressible pad.

The upper section of the heel of each foot 300 has a compressible layer 106 around the ankle assembly 108 to simulate softness of the tendon on the back of a human foot.

The compressible layer 106 can be formed of silicon or like material, as solid polymer or foam polymer.

The lower section of the heel of each foot 300 has a fourth compressible pad 107 to simulate the feel of a human heel.

The ankle assembly 108 can be a block of machined metal. The ankle assembly 108 can have a limited bending angle with side neoprene washers to simulate axial rotation of a human knee. The ankle assembly 108 has the following ranges of motion:

Dorsi Flexion: 0°-50°

Plantar Flexion: 0°-20°

Inversion: 0°-35°

Eversion: 0°-15°

The foot 300 comprises a first portion 301, a second portion 302, and a rod assembly 109. The rod assembly 109 is configured to allow the first portion 301 of the foot 300 to move relative to the second portion 302 of the foot 300. The longitudinal axis L1 of the rod in the rod assembly 109 and the plane P1 for the bottom of the foot 300 are shown in FIG. 1. The angle between the longitudinal axis L1 and the plane P1 is in the range of from 0° to 45°; and can be greater than 0°, 1°, 2°, 3°, 4°, 5°, 6°, 7°, 8°, 9°, 9°, or 10° and less than 45°, 44°, 43°, 42°, 41°, 40°, 39°, 38°, 37°, 36°, 35°, 34°, 33°, 32°, 31°, 30°, 29°, 28°, 27°, 26°, 25°, 24°, 23°, 22°, 21°, or 20°. In aspects, the direction of rotation of the first portion 301 of the foot 300 is perpendicular to the longitudinal axis L1 of a rod in the rod assembly 109.

The compressible pad 102 and compressible pad 104 are included in the legs 200 so that when the upper leg 201 bends against the lower leg 202 via the knee assembly 103, the compressible pad 102 and compressible pad 104 face one another. If the practitioner using the dummy has a body part between the compressible pad 102 and the compressible pad 104, instead of crushing the practitioner's body part, the compressible pad 102 and the compressible pad 104 of the disclosed dummy are configured to compress without applying a crushing force to the practitioner's body part.

Figure 2A:
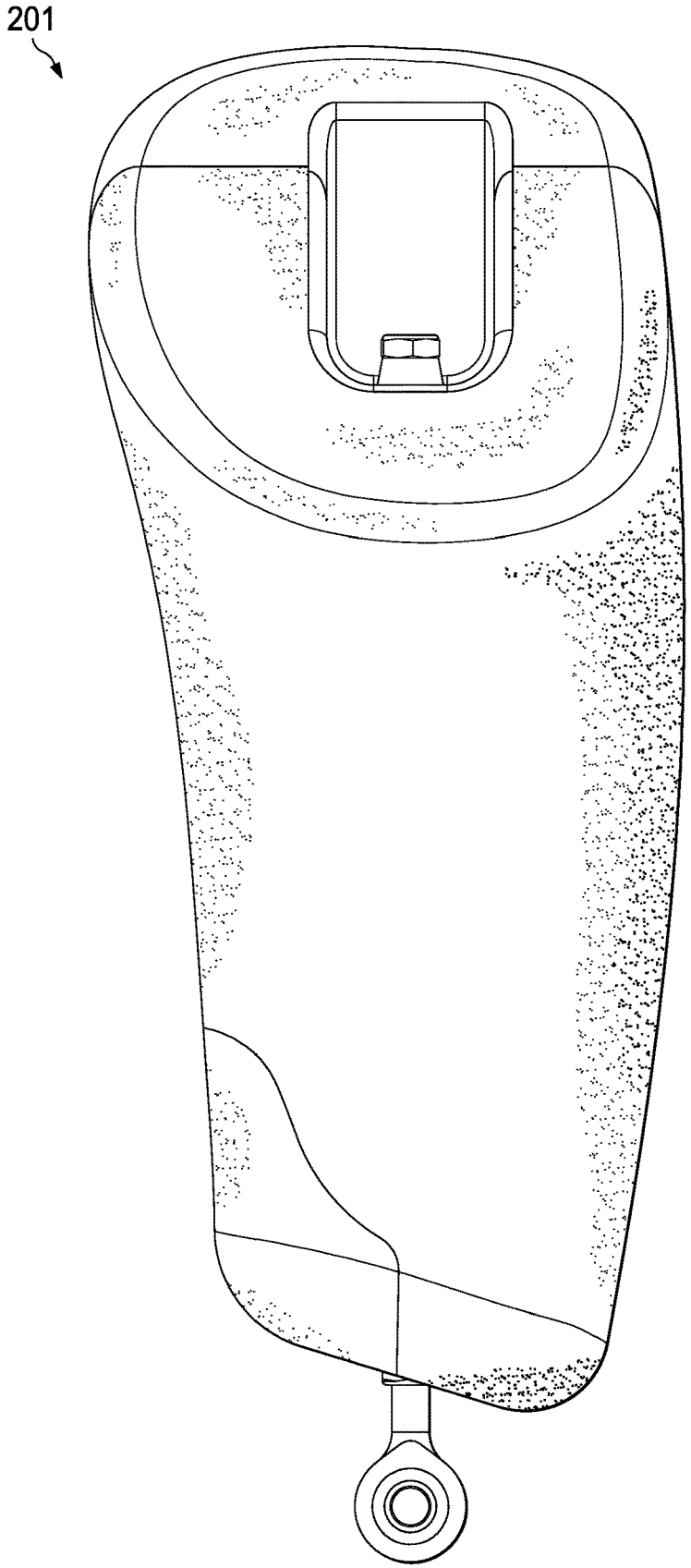
FIGS. 2A-2E illustrate various perspective views as well as a cross-sectional view of an upper leg in accordance with an embodiment of the present disclosure.
Figure 2B:
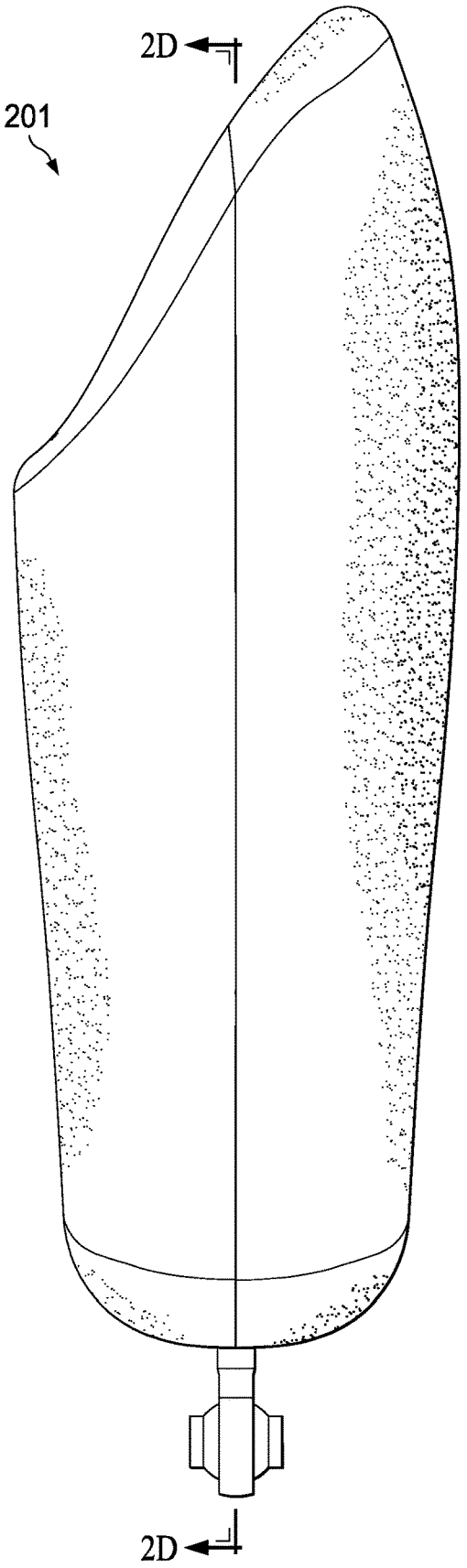
Figure 2C:
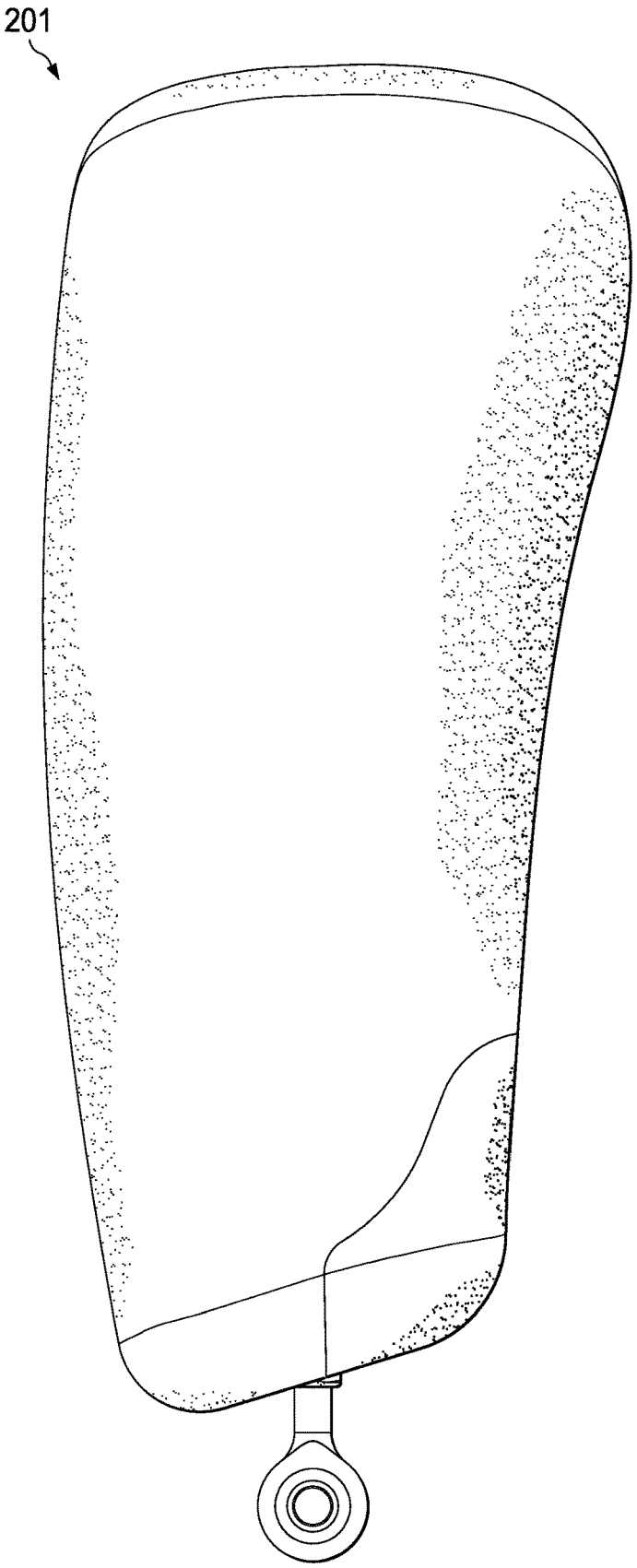

FIGS. 2A-2E illustrate various perspective views as well as a cross-sectional view of the upper leg 201 in accordance with an embodiment of the present disclosure. It should be noted that the upper leg 201 shown in the view of FIG. 2 is for the left leg, and a right upper leg would be an identical mirror image of all views shown in FIG. 2. In particular, FIG. 2A illustrates an inner thigh perspective view of the upper leg 201, FIG. 2B illustrates a front perspective view of the upper leg 201, and FIG. 2C illustrates an outer thigh perspective view of the upper leg 201.

Figure 2D:
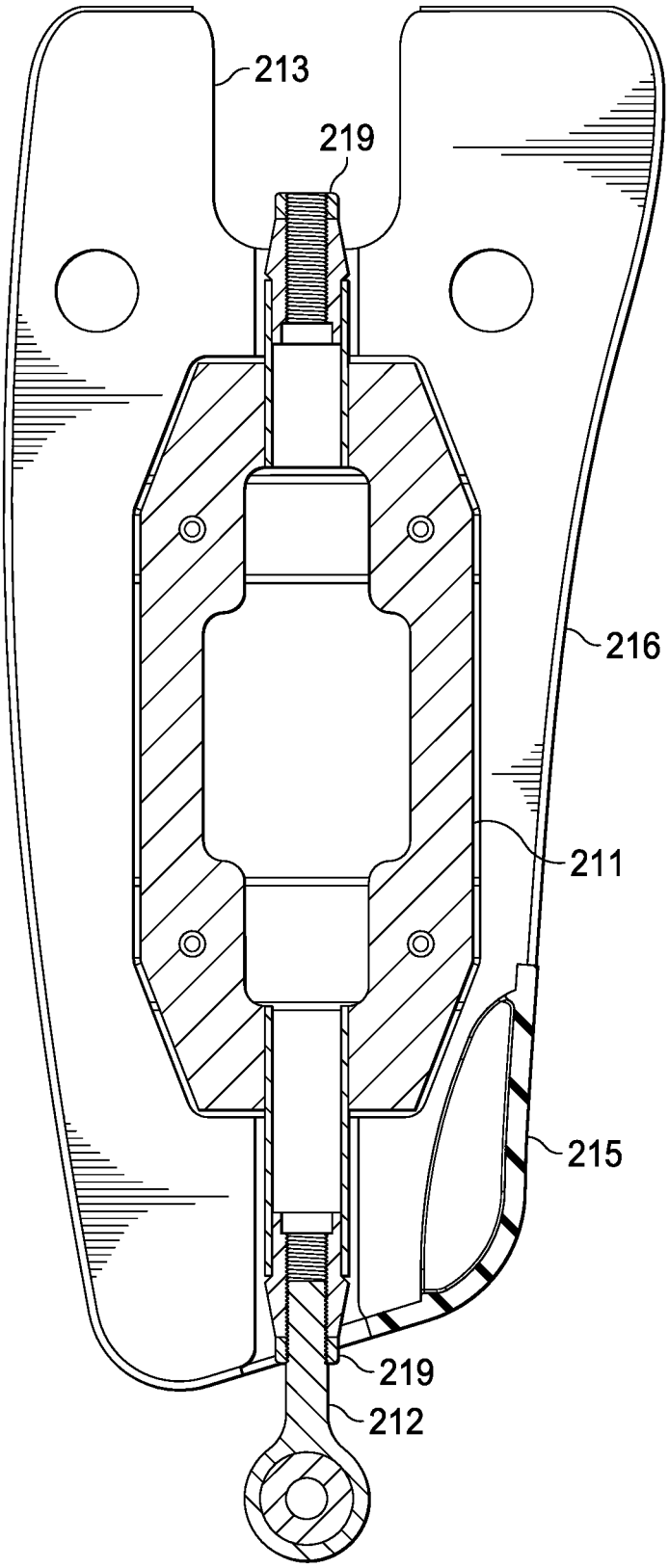
Figure 2E:
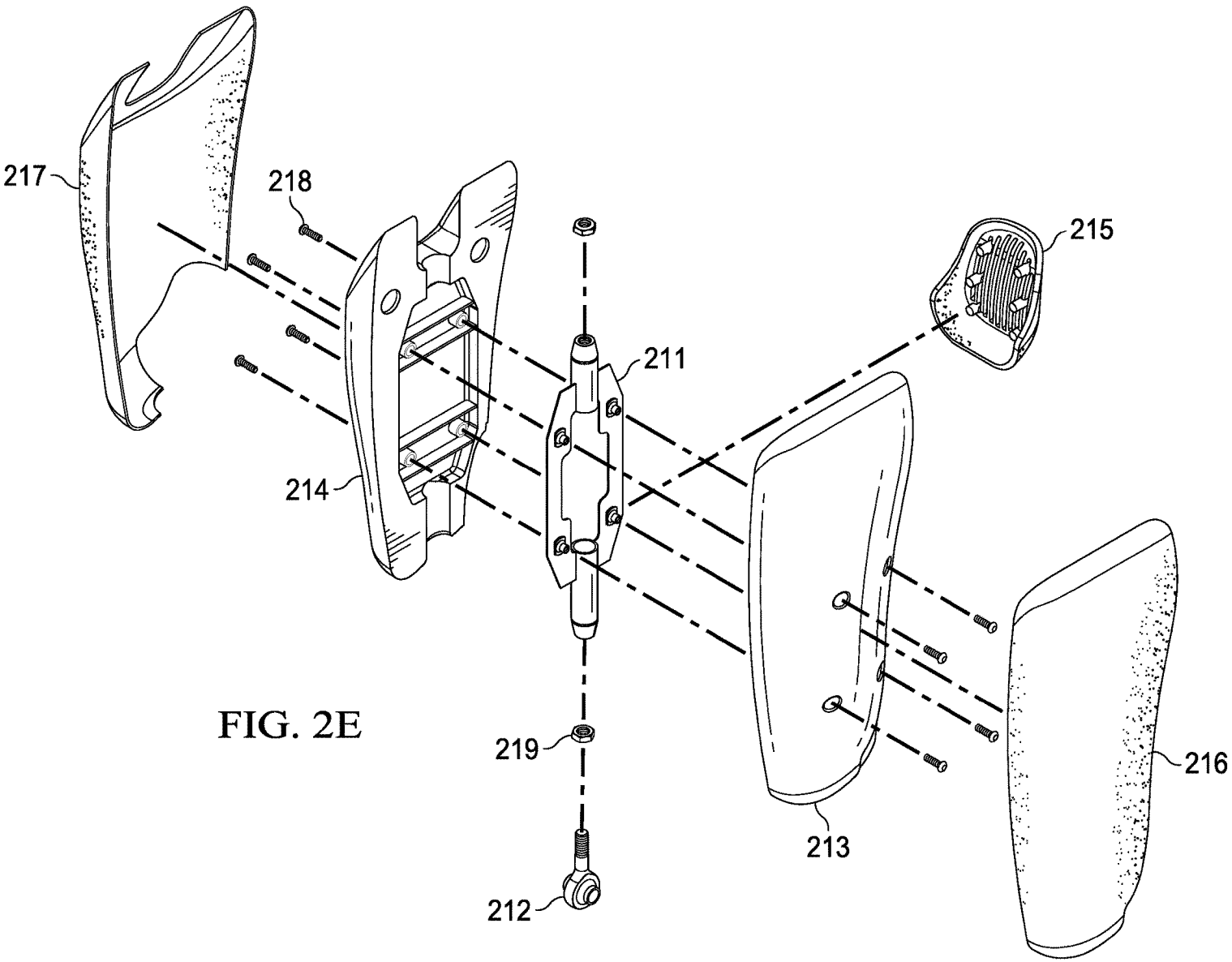

FIG. 2D illustrates a cross-sectional view taken along sight line 2D-2D of the upper leg 201 as indicated in FIG. 2B. Table 1 provides a description of the parts corresponding to the reference numerals in FIGS. 2D and 2E:

TABLE 1

| Item Reference No. | Description | Quantity |
|---|---|---|
| 211 | Weldment Thigh Structure | 1 |
| 212 | Swivel Ball Joint | 1 |
| 213 | Thigh, Outer Left | 1 |
| 214 | Thigh, Inner | 1 |
| 215 | Cushion, Thigh | 1 |
| 216 | Skin, Cover | 1 |
| 217 | Skin, Cover | 1 |
| 218 | Button Head Hex Drive Screws | 8 |
| 219 | Thin Nylon4-Insert Locknut | 2 |

The thigh cushion 215 in FIG. 2D is the compressible pad 102 of FIG. 1. In an embodiment, the top of the thigh cushion 215 has a thickness that is less than the thickness of the bottom of the thigh cushion 215.

Figure 3A:
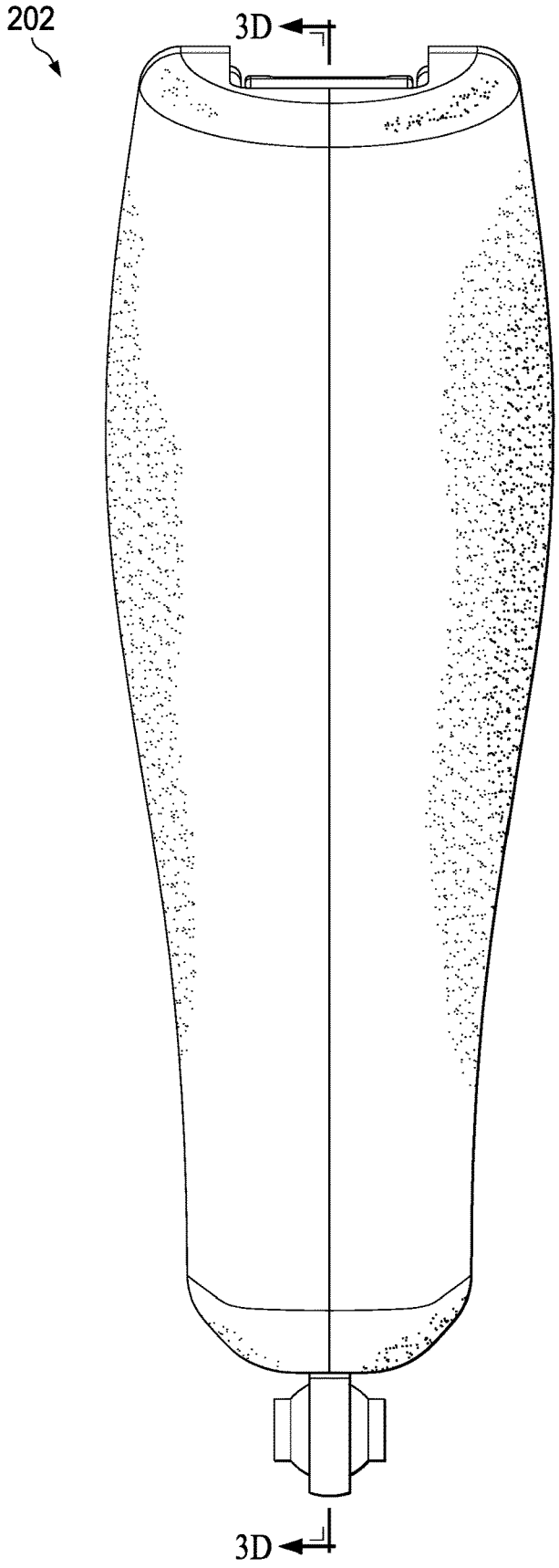
FIGS. 3A-3E illustrate various perspective views as well as a cross-sectional view of a lower leg in accordance with an embodiment of the present disclosure.
Figure 3B:
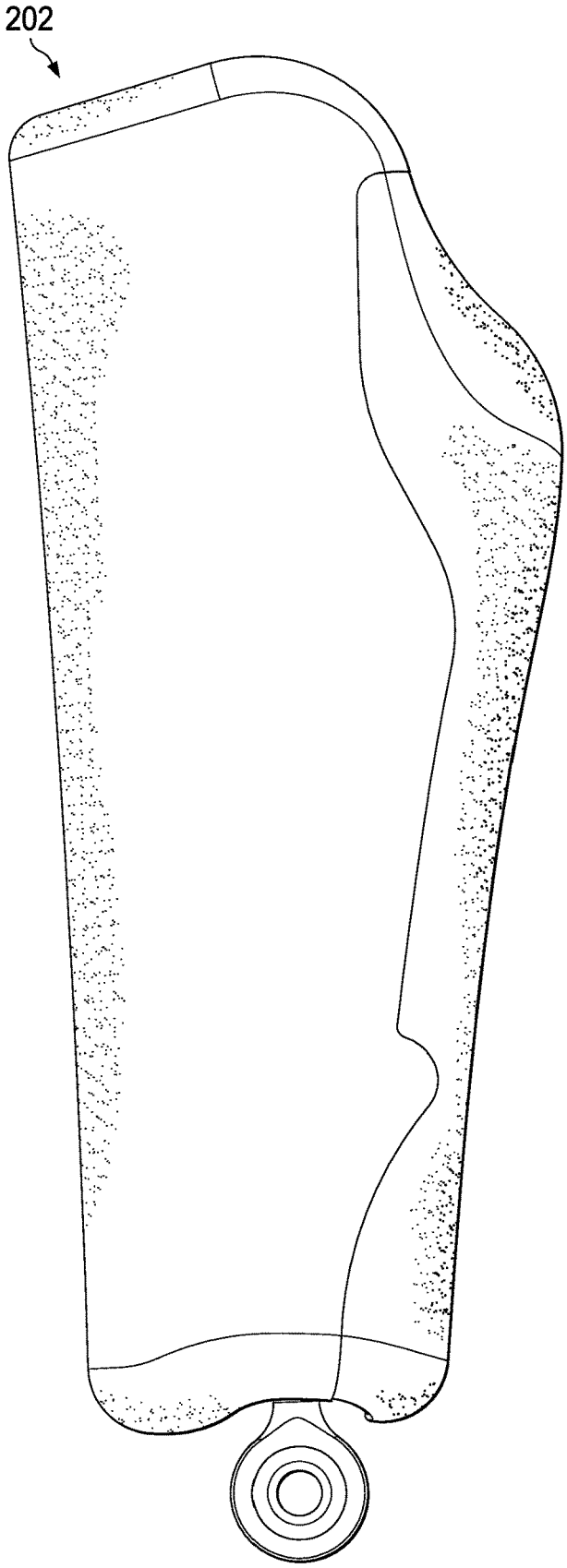
Figure 3C:
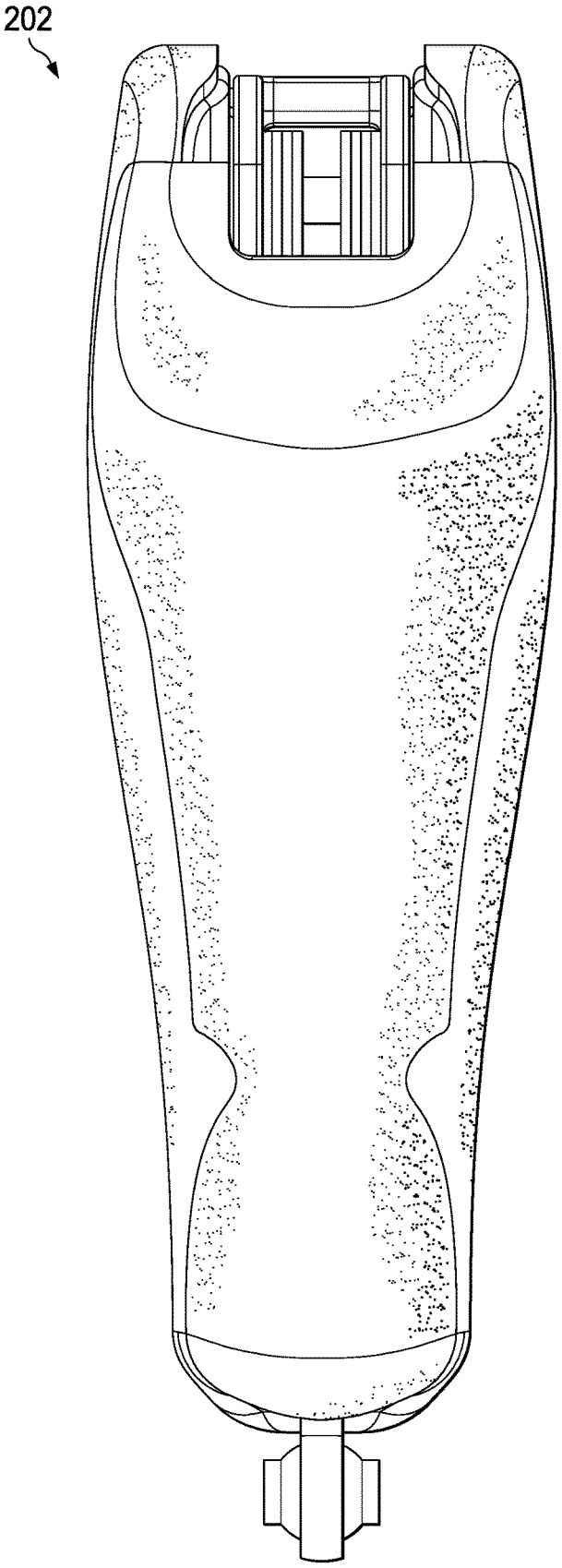

FIGS. 3A-3E illustrate various perspective views as well as a cross-sectional view of the lower leg 202 in accordance with an embodiment of the present disclosure. It should be noted that the lower leg 202 shown in the view of FIGS. 3A-3E is for the left leg, and a right lower leg would be an identical mirror image of all views shown in FIGS. 3A-3E. In particular, FIG. 3A illustrates a front perspective view of the lower leg 202, FIG. 3B illustrates a left outer view of the lower leg 202, and FIG. 3C illustrates a rear perspective view of the lower leg 202.

Figure 3D:
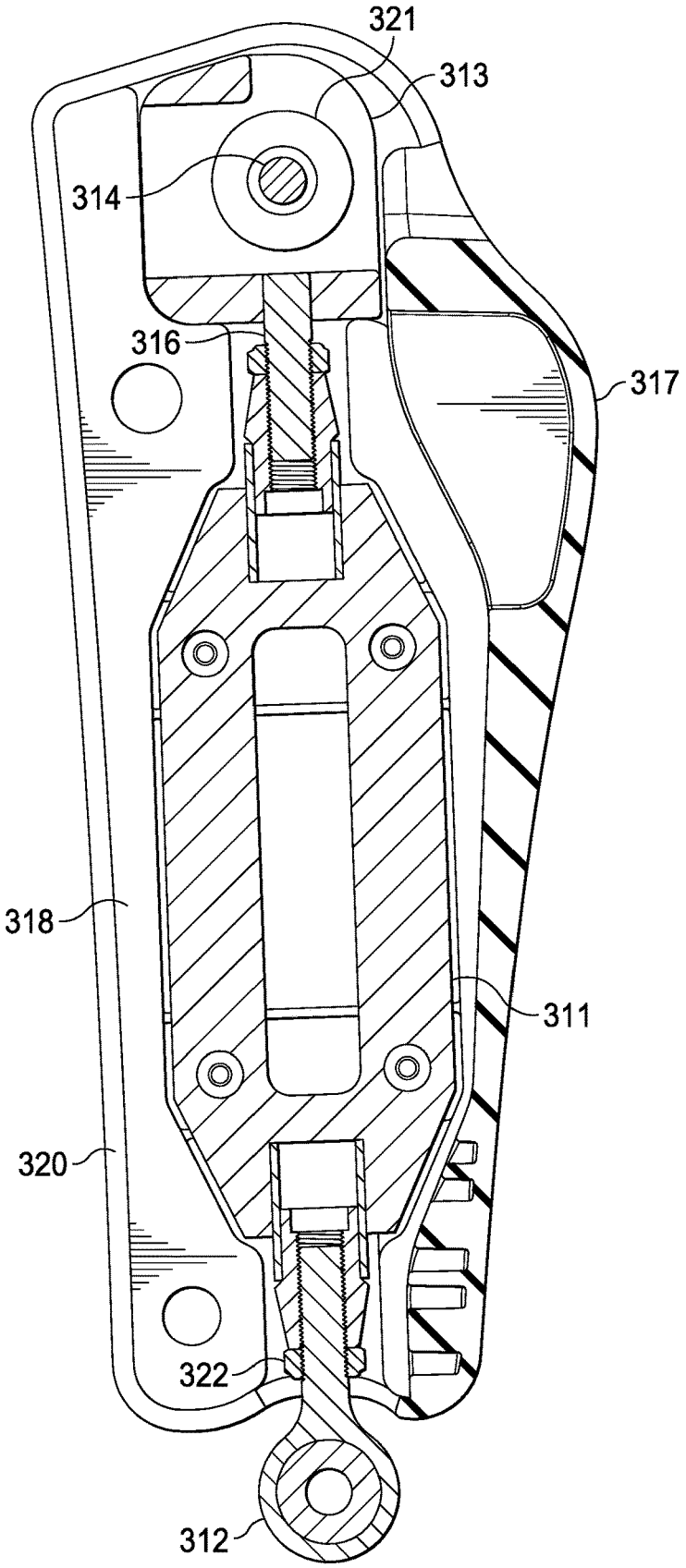
Figure 3E:
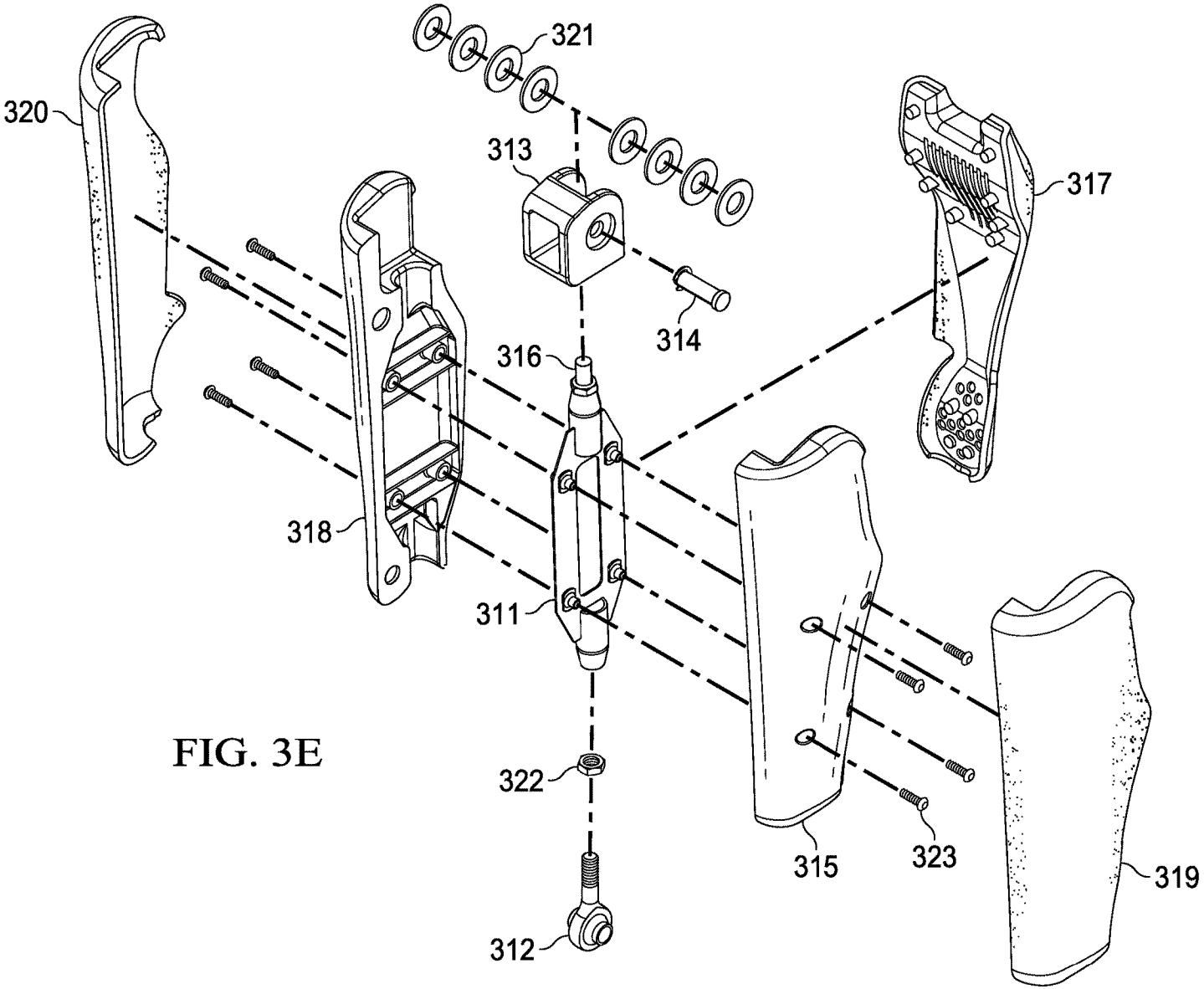

FIG. 3D illustrates a cross-sectional view taken along sight line 3D-3D of the lower leg 202 as indicated in FIG. 3A. Table 2 provides a description of the parts corresponding to the reference numerals in FIGS. 3D and 3E:

TABLE 2

| Item Reference No. | Description | Quantity |
|---|---|---|
| 311 | Weldment Leg Structure | 1 |
| 312 | Swivel Ball Joint | 1 |
| 313 | Machined Knee Joint | 1 |
| 314 | Grooved Clevis Pin with Retaining Ring | 1 |
| 315 | Leg, Calf Left-Side | 1 |
| 316 | One-End Threaded Stud with Cotter Pin | 1 |
| 317 | Leg, Lower Section Soft Gel | 1 |
| 318 | Leg, Calf R-Side | 1 |
| 319 | Skin, Cover | 1 |
| 320 | Skin, Cover | 1 |
| 321 | Neoprene Sealing Washer | 8 |
| 322 | Thin Nylon-Insert Locknut | 2 |
| 323 | Button Head Hex Drive Screws | 8 |

The lower leg section soft gel 317 in FIG. 3D is the compressible pad 104 of FIG. 1. In an embodiment, the top of the lower leg section soft gel 317 has a thickness that is greater than the thickness of the bottom of the lower leg section soft gel 317. In certain embodiments, when the upper leg 201 and lower 202 are bent against each other, the thickest portion of the thigh cushion 215 (compressible pad 102) and the thickest portion of the lower section soft gel 317 (compressible pad 104) face one another.

Figure 4A:
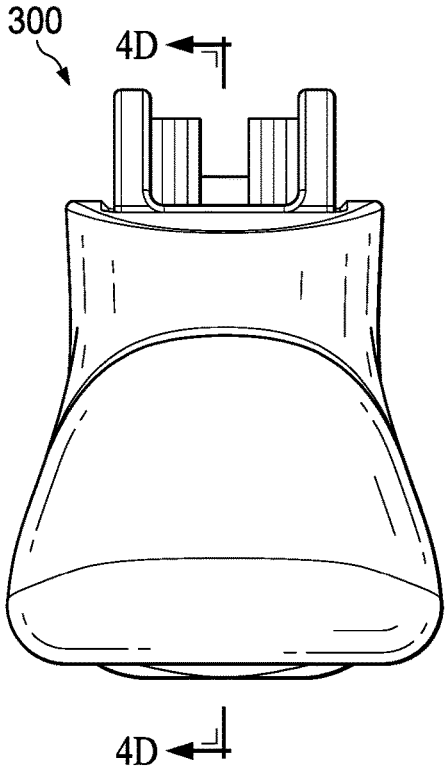
FIGS. 4A-4E illustrate various perspective views as well as a cross-sectional view of a foot in accordance with an embodiment of the present disclosure.
Figure 4B:
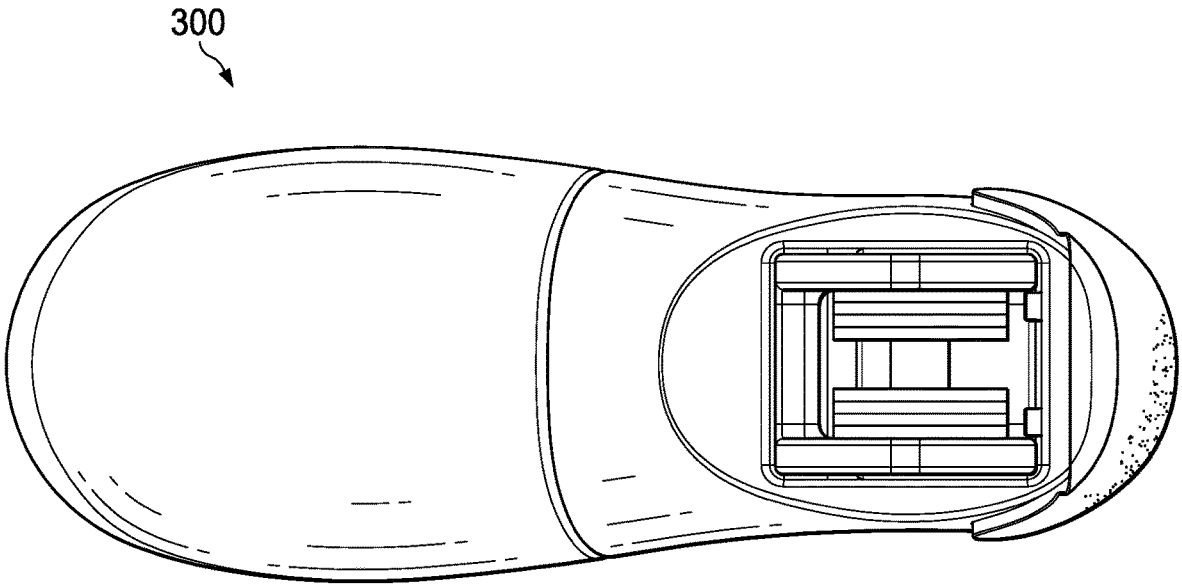
Figure 4C:
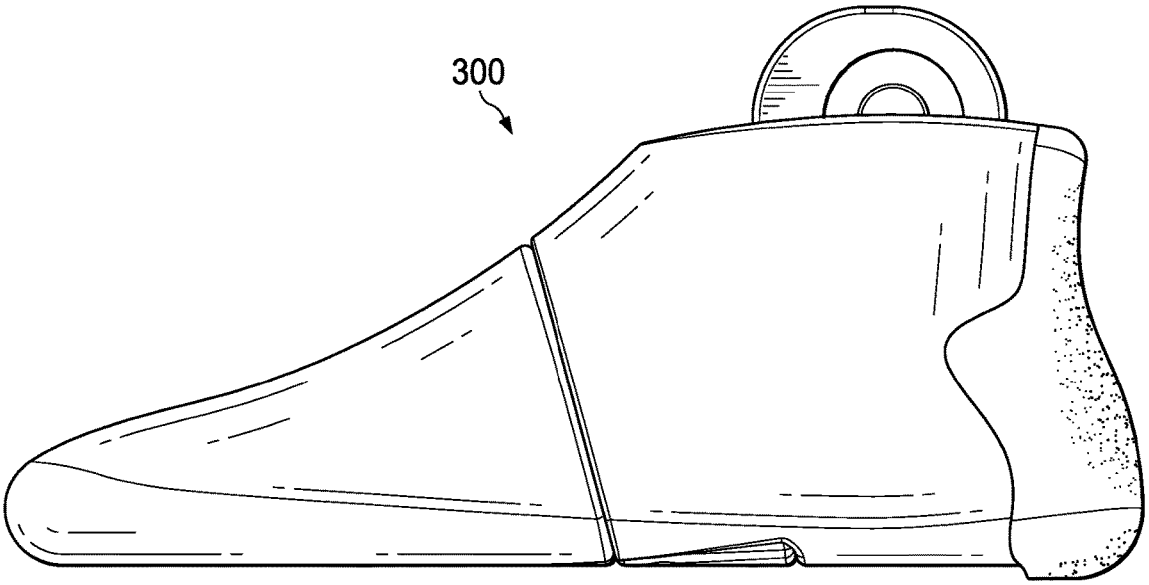

FIGS. 4A-4E illustrate various perspective views as well as a cross-sectional view of the foot 300 in accordance with an embodiment of the present disclosure. The foot 300 illustrated in the views of FIGS. 4A-4E can be used as a right foot and left foot. In particular, FIG. 4A illustrates a front perspective view of the foot 300, FIG. 4B illustrates a top perspective view of the foot 300, and FIG. 4C illustrates a side perspective view of the foot 300.

Figure 4D:
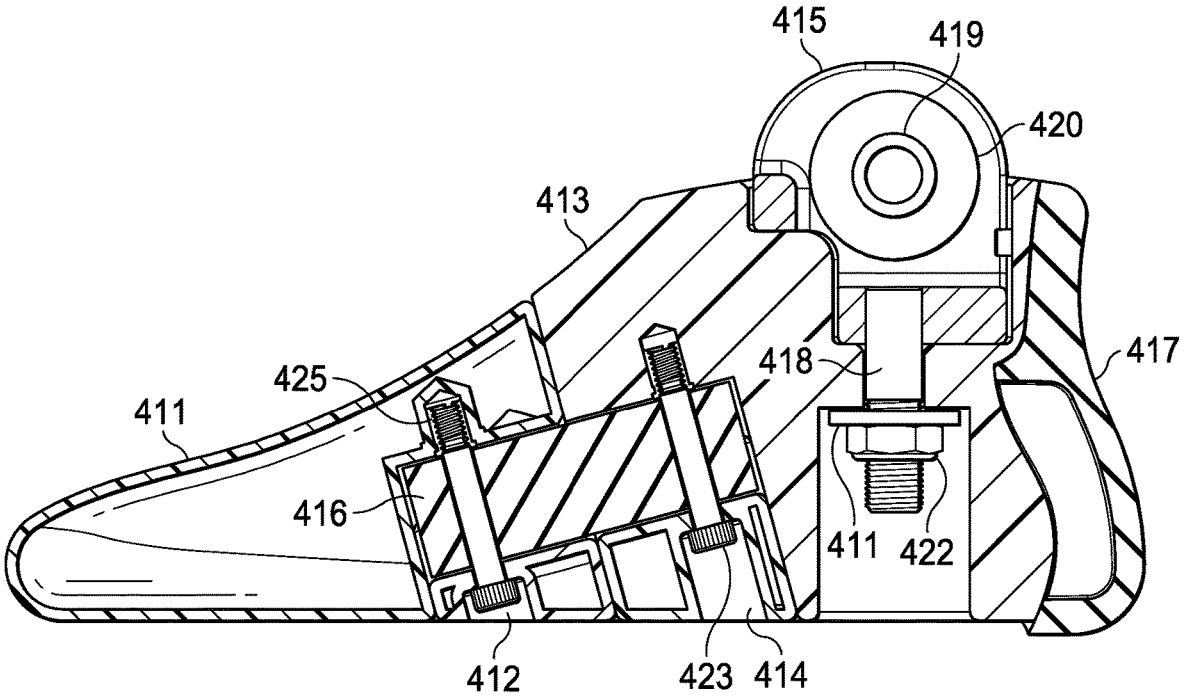
Figure 4E:
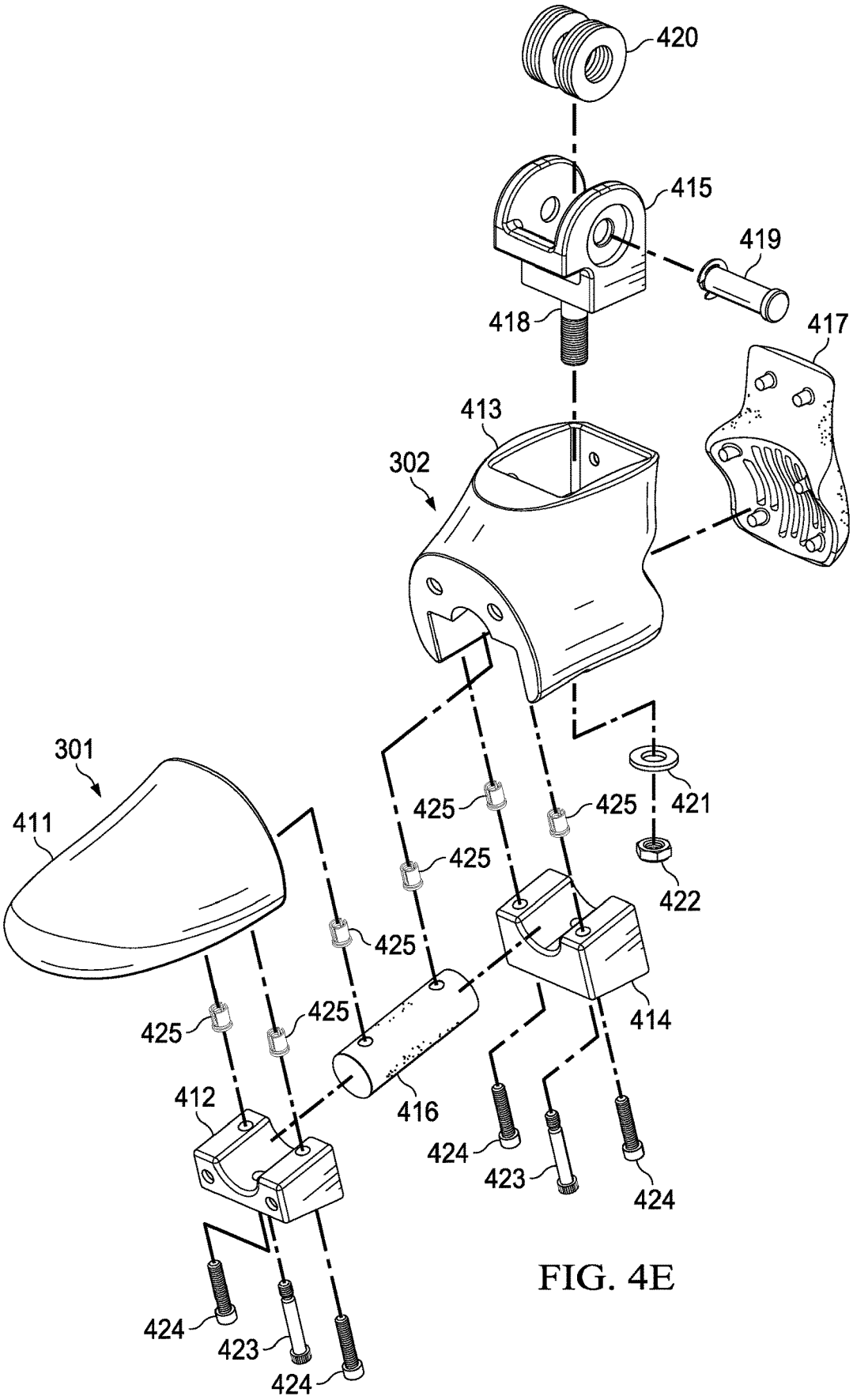

FIG. 4D illustrates a cross-sectional view taken along sight line 4D-4D of the foot 300 as indicated in FIG. 4A. FIG. 4E illustrates an exploded view of the foot 300. Table 3 provides a description of the parts corresponding to the reference numerals in FIGS. 4D and 4E:

TABLE 3

| Item Reference No. | Description |
|---|---|
| 411 | Front Toe |
| 412 | Front Toe Cap |
| 413 | Foot Heel |
| 414 | Foot Heel Cover |
| 415 | Machined Ankle Joint |
| 416 | Rod, Rubber 1.0 In Diameter |
| 417 | Foot Heel Rubber |
| 418 | 1/2-20 Partial Threaded Stud |
| 419 | Clevis Pins with Retaining Ring Groove |

TABLE 3-continued

| Item Reference No. | Description |
|---|---|
| 420 | Neoprene Sealing Washer |
| 421 | Flat Washer |
| 422 | Nylon-Insert Locknut |
| 423 | Shoulder Screw |
| 424 | Socket Head Cap Screw |
| 425 | Screw Insert |

A rod assembly 109 in FIG. 1 can include any components in FIGS. 4D and 4E that are configured to secure the rod 416 of FIGS. 4D and 4E to the foot 300 for rotation of the first portion 301 of the foot 300 relative to the second portion 302 of the foot 300. In FIG. 4D, the rod 416 of the rod assembly can be seen having one end extending in the first portion 301 of the foot 300 and an opposite extending in the second portion 302 of the foot 300. The first end of the rod 416 is secured, attached, or otherwise connected to the first portion 301 in the manner shown in FIGS. 4D and 4E; however, it is contemplated that the first end of the rod 416 can be secured to the first portion 301 by other techniques, such as adhesive, or welding (e.g., of metal or polymer parts together). The second end of the rod 416 is secured, attached, or otherwise connected to the second portion 302 in the manner shown in FIGS. 4D and 4E; however, it is contemplated that the second end of the rod 416 can be secured to the second portion 302 by other techniques, such as adhesive, or welding (e.g., of metal or polymer parts together).

FIGS. 5A to 5F illustrate various perspective views and positions of the first portion 301 of the foot 300 relative to the second portion 302 of the foot 300 in accordance with an embodiment of the present disclosure.

Figure 5A:
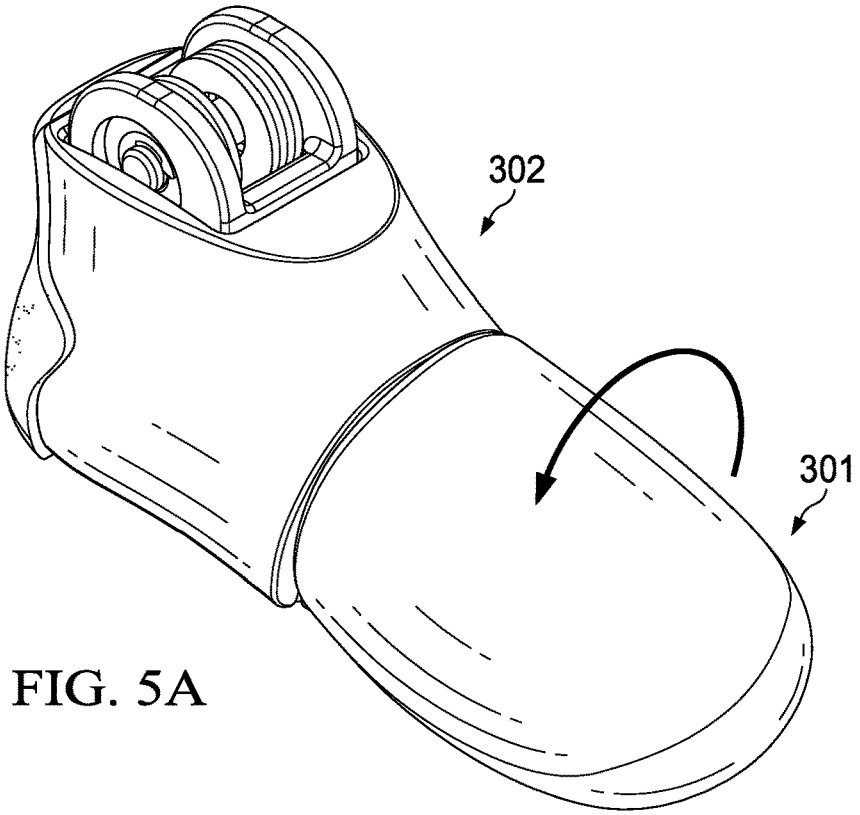
FIGS. 5A-5F illustrate various perspective views and positions of a first portion of a foot relative to a second portion of a foot in accordance with an embodiment of the present disclosure.

FIG. 5A shows, when viewed from the front of the foot 300, the first portion 301 rotated counter-clockwise along the longitudinal axis L1 of the rod 416 with respect to the second portion 302. The angle of counter-clockwise rotation can be 0-45° for example. The angle of rotation depends on the material of construction of the rod 416 of the foot 300, which is described in more detail below. Generally, one end of the rod 416 that is secured or otherwise attached to the first portion 301 of the foot 300 twists in the counter-clockwise direction when under a torsional force in the counter-clockwise direction with respect to an opposite end of the rod 416 that is secured or otherwise attached to the second portion 302 of the foot 300.

Figure 5B:
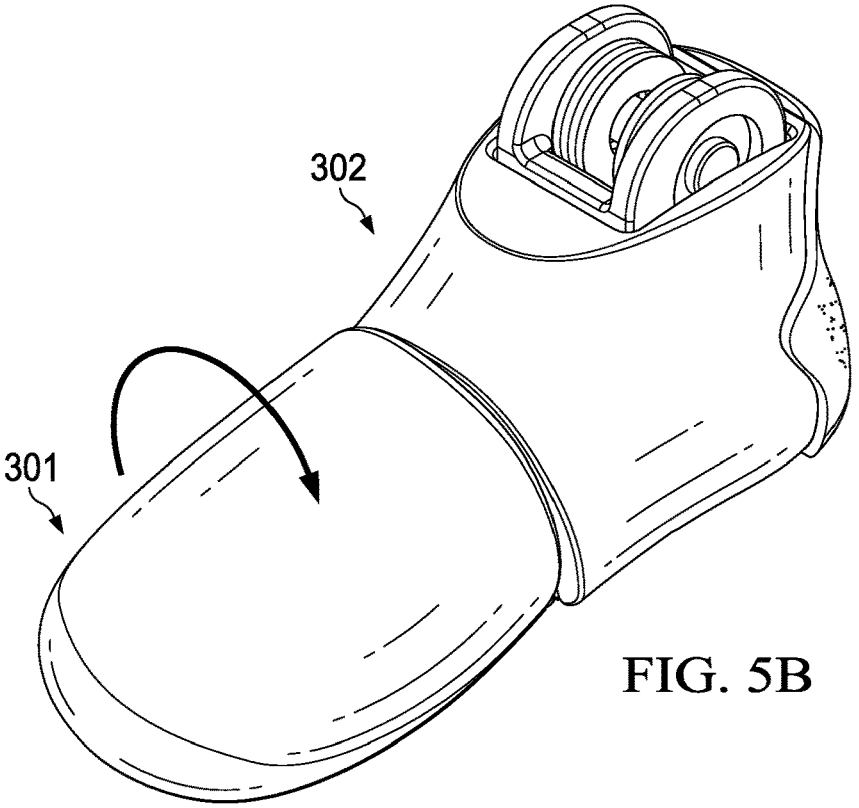

FIG. 5B shows, when viewed from the front of the foot 300, the first portion 301 rotated clockwise along the longitudinal axis L1 of the rod 416 with respect to the second portion 302. The angle of clockwise rotation can be 0-45° for example. The angle of rotation depends on the material of construction of the rod 416 of the foot 300, which is described in more detail below. Generally, one end of the rod 416 that is secured or otherwise attached to the first portion 301 of the foot 300 twists in the clockwise direction when under a torsional force in the clockwise direction with respect to an opposite end of the rod 416 that is secured or otherwise attached to the second portion 302 of the foot 300.

Figure 5C:
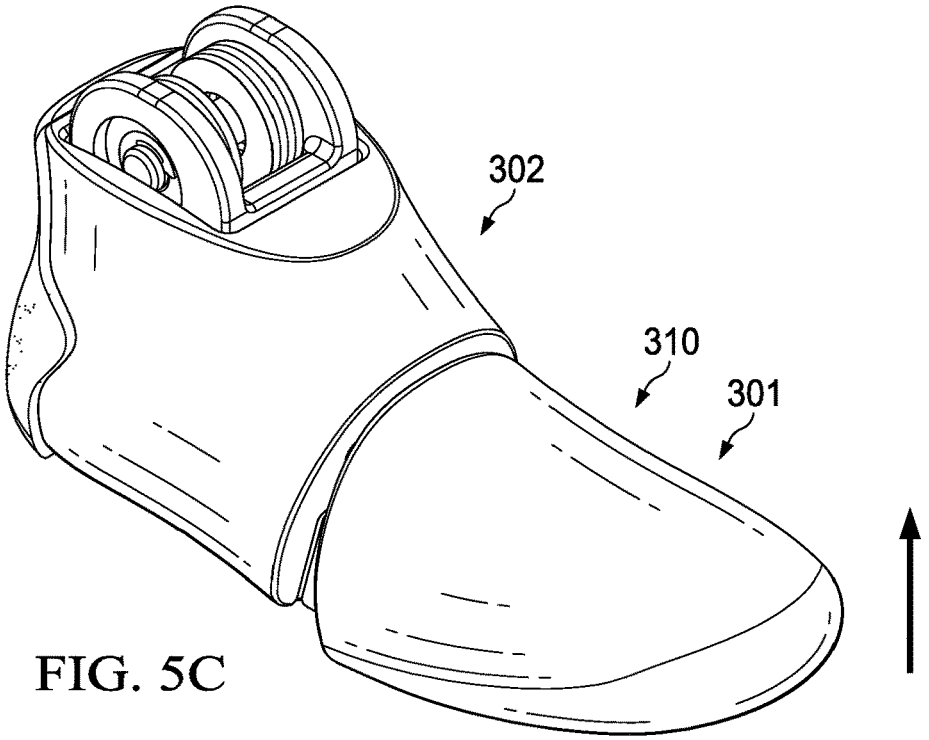

FIG. 5C shows, when viewed from the front of the foot 300, the toe 310 of the first portion 301 of the foot 300 pulled upward, causing the first portion 301 to move relative to the second portion 302 as shown in FIG. 5C. The angle of upward movement of the toe 310 can be 0-15° with respect to the longitudinal axis L1 of the rod 416 when in the resting position, for example. The angle of upward movement of the toe 310 depends on the material of construction of the rod 416 of the foot 300, which is described in more detail below.

Figure 5D:
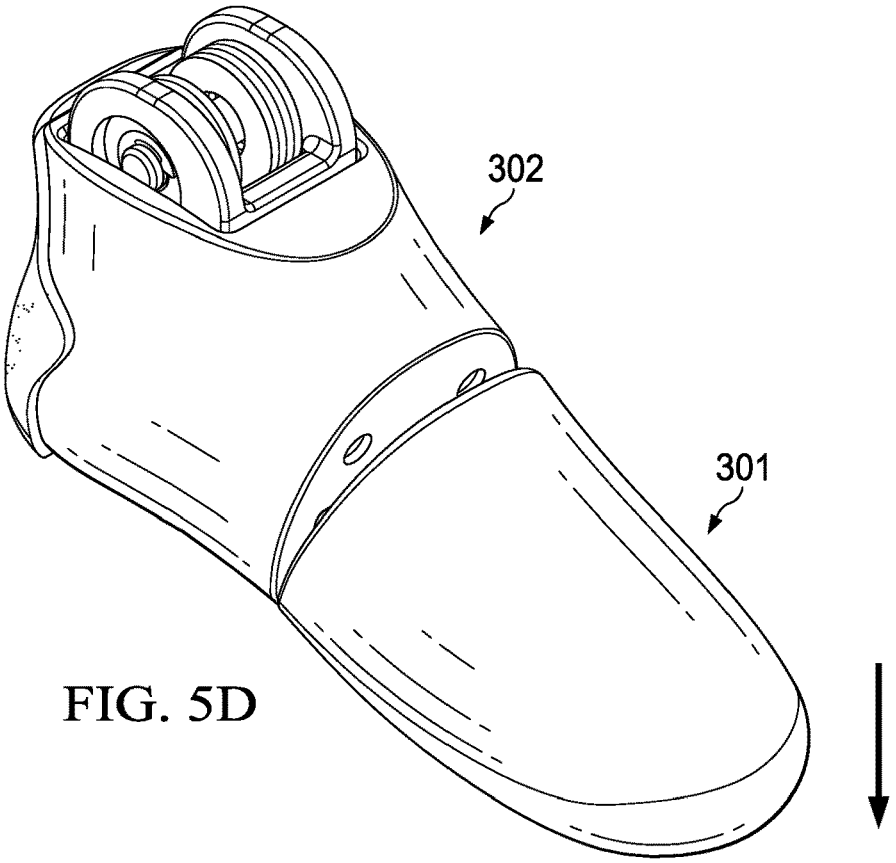

FIG. 5D shows, when viewed from the front of the foot 300, the toe 310 of the first portion 301 of the foot 300 pulled downward, causing the first portion 301 to move relative to the second portion 302 as shown in FIG. 5D. The angle of downward movement of the toe 310 can be 0-15° with respect to the longitudinal axis L1 of the rod 416 when in the resting position, for example. The angle of downward movement of the toe 310 depends on the material of construction of the rod 416 of the foot 300, which is described in more detail below.

Figure 5E:
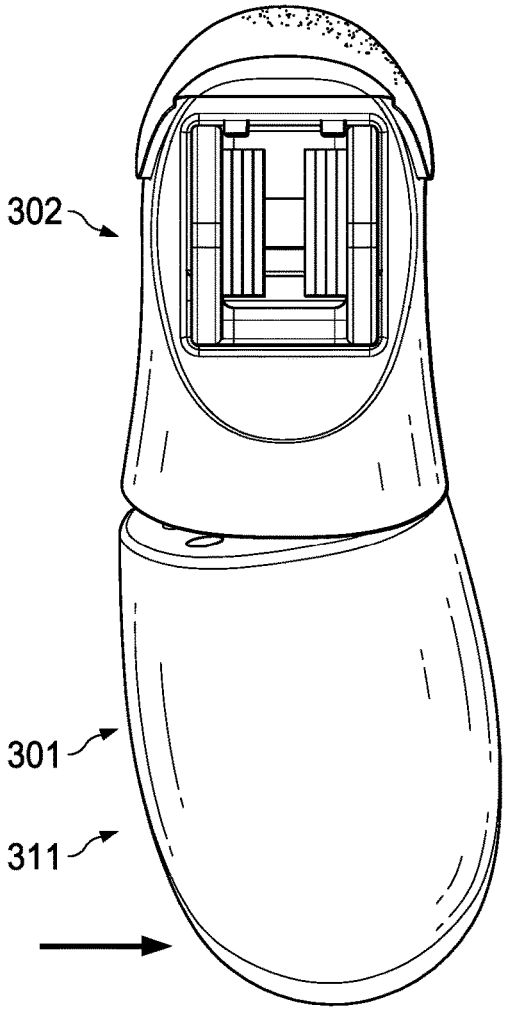

FIG. 5E shows, when viewed from the top of the foot 300, the side 311 of the first portion 301 of the foot 300 pushed laterally relative to the second portion 302 of the foot 300 in the direction shown in FIG. 5E. The angle of lateral movement of the first portion 301 in the direction shown in FIG. 5E can be 0-15° with respect to the longitudinal axis L1 of the rod 416 when in the resting position, for example. The angle of lateral movement of the first portion 301 depends on the material of construction of the rod 416 of the foot 300, which is described in more detail below.

Figure 5F:
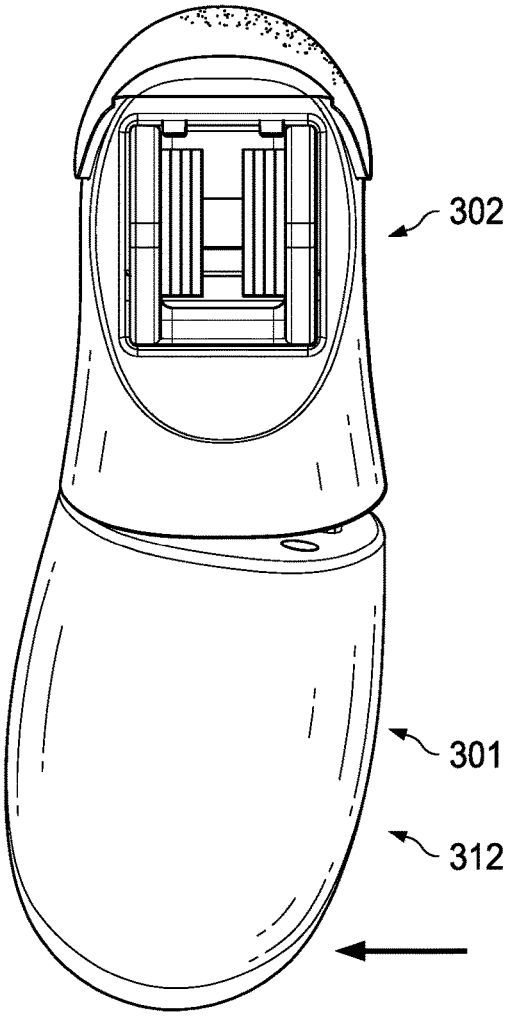

FIG. 5F shows, when viewed from the top of the foot 300, the side 312 of the first portion 301 of the foot 300 pushed laterally relative to the second portion 302 of the foot 300 in the direction shown in FIG. 5F. The angle of lateral movement of the first portion 301 in the direction shown in FIG. 5F can be 0-15° with respect to the longitudinal axis L1 of the rod 416 when in the resting position, for example. The angle of lateral movement of the first portion 301 depends on the material of construction of the rod 416 of the foot 300, which is described in more detail below.

While FIGS. 5A to 5F show isolated movements of the first portion 301 of the foot 300 relative to the second portion 302 of the foot 300, it is contemplated that the movement of the first portion 301 relative to the second portion 302 can be a combination of the movements shown in FIGS. 5A to 5F (e.g., FIGS. 5A, 5C, and 5E; FIGS. 5A, 5D, and 5E; FIGS. 5A, 5C, and 5F; FIGS. 5A, 5D, and 5F; FIGS. 5B, 5C, and 5E; FIGS. 5B, 5D, and 5E; FIGS. 5B, 5C, and 5F; FIGS. 5B, 5D, and 5F).

Figure 6:
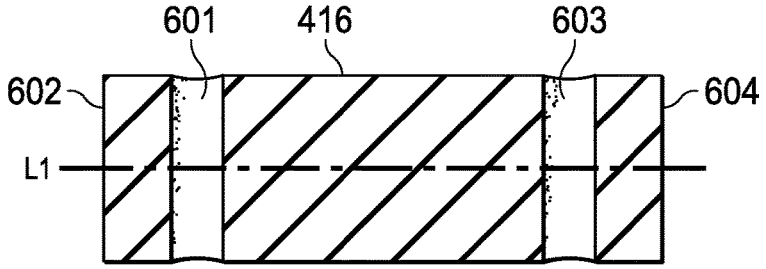
FIG. 6 illustrates a cross-sectional view of a rod in FIG. 4 in accordance with an embodiment of the present disclosure.

FIG. 6 illustrates a cross-sectional view of the rod 416 in FIG. 4 in accordance with an embodiment of the present disclosure. In aspects, the rod 416 is a flexible rod, in the sense that, the rod 416 can elongate under tensile load, twist about the longitudinal axis L1 under torsional force, bend the longitudinal axis, and remain in a cylindrical shape when no load or force is applied to the rod 416. In certain embodiments, the rod 416 has a cylindrically-shaped body; alternatively, the rod can have the cross section of any polygon as long as the rod is a flexible rod in the directions disclosed herein.

In some embodiments, the rod 416 have the shape of a solid cylinder or otherwise a solid prism (triangular rod, square rod, pentagonal rod, hexagonal rod, and so on). Alternatively, the shape of the rod 416 can be a hollow cylinder (e.g., tube shape) or hollow prism (e.g., polygonal tube).

In certain embodiments, the rod 416 can be formed of a polymer material. The polymer material can be configured to elongate under tensile load, rotate under torsional force, and bend; and configured to be in the cylindrical or prism shape when no load is applied. The polymer can be formed from one or more polymerization processes that produce homopolymer or copolymer from any monomer unit such as, for example but not limited to, ethylene, propylene, butene, pentene, butadiene, hexene, styrene, any other known monomer useful for forming the flexible rod, and combinations thereof. Examples of suitable polymer materials from which the rod 416 can be made include polyethylene (linear low density, low density, medium density, high density, or combinations thereof), polypropylene, polystyrene, nylon, polycarbonate, acetal material, acrylonitrile, acrylonitrile butadiene styrene, acrylic material, polybenzimidazole, polyethylene terephthalate, polyether ether ketone, phenolic laminates, polyvinylidene fluoride, polytetrafluoroethylene, or combinations thereof.

In aspects where the rod 416 has end 602 secured to the first portion 301 and opposite end 604 secured to the second portion 302 of the foot 300 as shown in FIG. 4D, the holes 601 and 603 are formed in the ends 602 and 604 of the rod 416 so that bolts or screws can secure, attach, or otherwise connect the end 602 to the first portion 301 of the foot 300 and the opposite end 604 to the second portion 302 of the foot 300.

The longitudinal axis L1 of FIG. 1 is shown in FIG. 6 for reference of direction of the rod 416—that is in rod assembly 109 of FIG. 1.

In certain embodiments, the rod 416 can have a diameter in the range of 0.25 inch to 1.5 inches (0.635 cm to 3.81 cm); alternatively, in the range of 0.5 inch to 1.25 inches (1.27 cm to 3.175 cm); alternatively, about 1 inch (about 2.54 cm).

In certain embodiments, the rod 416 can have a length in the range of 0.5 inch to 6 inches (1.27 cm to 15.24 cm); alternatively, in the range of 0.75 inch to 4 inches (1.90 cm to 10.16 cm); alternatively, in the range of about 1 inch to about 4 inches (2.54 cm to 10.16 cm).

Any embodiment of the lower half of the martial arts dummy disclosed herein can be used in combination with any upper half (e.g., torso, arms, hands, neck, head) of a dummy or mannequin, in order to form a full martial arts dummy.

While several embodiments have been provided in the present disclosure, it should be understood that the disclosed dummy may be embodied in many other specific forms without departing from the spirit or scope of the present disclosure. The present examples are to be considered as illustrative and not restrictive, and the intention is not to be limited to the details given herein. For example, the various elements or components may be combined or integrated in another form or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A training dummy comprising:

a waist portion;

a first leg coupled to the waist portion;

a second leg coupled to the waist portion;

a first foot coupled to the first leg; and a second foot coupled to the second leg;

wherein at least one of the first foot or the second foot comprises:

a front foot portion;

a back foot portion; and a rod assembly coupling the front foot portion to the back foot portion, wherein the front foot portion is configured to move with respect to the back foot portion.

2. The training dummy of claim 1, wherein at least one of the first leg or the second leg comprises:

an upper leg portion having a first compressible pad on a bottom section of the upper leg portion; and a lower leg portion coupled to the upper leg portion, the lower leg portion having a second compressible pad on an upper section of the lower leg portion.

3. The training dummy of claim 2, further comprising a swivel ball joint on the upper leg portion, the swivel ball joint configured to couple the upper leg portion to a knee assembly of the lower leg portion.

4. The training dummy of claim 3, wherein the knee assembly has a flexion range 0°-130°.

5. The training dummy of claim 3, wherein the knee assembly has as extension range 120°-0°.

6. The training dummy of claim 2, further comprising a swivel ball joint on the lower leg portion, the swivel ball joint configured to couple the lower leg portion to an ankle assembly of the first foot or the second foot.

7. The training dummy of claim 6, wherein the ankle assembly has a dorsi flexion range of 0°-50°.

8. The training dummy of claim 6, wherein the ankle assembly has a plantar flexion range of 0°-20°.

9. The training dummy of claim 2, wherein when the upper leg portion and the lower leg portion are bent against each other, a thickest portion of the first compressible pad of the upper leg portion and the thickest portion of the second compressible pad of the lower leg portion face one another.

10. The training dummy of claim 1, wherein the waist portion further comprises a hip joint configured to couple the first leg or the second leg to the waist portion, the hip joint configured to provide an axial rotation of +/−10° with respect to an upper leg portion of the first leg or the second leg.

11. The training dummy of claim 1, wherein the waist portion further comprises a hip joint configured to couple the first leg or the second leg to the waist portion, the hip joint configured to provide a lateral rotation of 0°-45° with respect to an upper leg portion of the first leg or the second leg.

12. The training dummy of claim 1, wherein the waist portion further comprises a hip joint configured to couple the first leg or the second leg to the waist portion, the hip joint configured to provide an extension of 0°-45° with respect to an upper leg portion of the first leg or the second leg.

13. The training dummy of claim 1, wherein at least one of the first leg or the second leg comprises a skeleton structure that is resistant to bending under applied pressure.

14. The training dummy of claim 1, wherein at least one of the first leg or the second leg comprises an inner layer of soft tissue and an outer layer of soft tissue, and wherein the inner layer of soft tissue has a hardness greater than the hardness of the outer layer of soft tissue.

15. The training dummy of claim 1, wherein at least one of the first leg or the second leg comprises a skin structure made of polyethylene, silicon, an open cell foam, or a combination thereof.

16. The training dummy of claim 1, wherein an angle of lateral movement of the front foot portion relative to the back foot portion is between 0-15°.

17. The training dummy of claim 1, wherein an angle of downward or upward movement of the front foot portion relative to the back foot portion is between 0-15°.

18. The training dummy of claim 1, wherein at least one of the first foot or the second foot comprises:

at least one of a compressible layer on a top portion of a heel of the respective first or second foot; or a compressible pad on a bottom portion of the heel of the respective first or second foot.

19. The training dummy of claim 1, wherein the rod assembly is configured to rotate along a longitudinal axis of a rod in the rod assembly so that the front foot portion rotates relative to the back foot portion.

20. The training dummy of claim 1, wherein an angle of a clockwise rotation or a counter-clockwise rotation of the front foot portion relative to the back foot portion is between 0-45°.

* * * * *